US010974519B2

(12) United States Patent
Nishizawa et al.

(10) Patent No.: US 10,974,519 B2
(45) Date of Patent: Apr. 13, 2021

(54) INKJET PRINTER AND CONTROL METHOD FOR INKJET PRINTER

(71) Applicant: MIMAKI ENGINEERING CO., LTD., Nagano (JP)

(72) Inventors: Ryo Nishizawa, Nagano (JP); Akira Takatsu, Nagano (JP); Yoshikazu Furukawa, Nagano (JP); Kosuke Miyake, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/745,371

(22) Filed: Jan. 17, 2020

(65) Prior Publication Data

US 2020/0230971 A1 Jul. 23, 2020

(30) Foreign Application Priority Data

Jan. 23, 2019 (JP) ..... JP2019-009239

(51) Int. Cl.
*B41J 2/175* (2006.01)
*B41J 2/18* (2006.01)

(52) U.S. Cl.
CPC ..... *B41J 2/18* (2013.01); *B41J 2/17596* (2013.01)

(58) Field of Classification Search
CPC ..... B41J 2002/16567; B41J 2/175; B41J 2/17596; B41J 2/18; B41J 29/38
See application file for complete search history.

(56) References Cited

U.S. PATENT DOCUMENTS

2012/0200649 A1* 8/2012 Igawa et al. ..... B41J 2/18
2016/0059547 A1* 3/2016 Kaneko ..... B41J 2/18

FOREIGN PATENT DOCUMENTS

JP 2011156859 8/2011

* cited by examiner

*Primary Examiner* — Anh T Vo
(74) *Attorney, Agent, or Firm* — JCIPRNET

(57) ABSTRACT

An inkjet printer includes an inkjet head that ejects ink droplets, and a sub tank that stores an ink to be supplied to the inkjet head, where the sub tank is provided with an ink outflow port through which the ink flows out from the sub tank, and an ink inflow port through which the ink that flowed out from the ink outflow port and passed through a predetermined circulation path flows toward the sub tank. In the inkjet printer, the ink is flowed out from the ink inflow port and the ink that passed through the circulation path is flowed into the sub tank from the ink outflow port at a predetermined timing.

15 Claims, 4 Drawing Sheets

INKJET PRINTER AND CONTROL METHOD FOR INKJET PRINTER

CROSS REFERENCE TO RELATED APPLICATIONS

This application claims the priority benefit of Japanese Patent Application No. 2019-009239, filed on Jan. 23, 2019. The entirety of the above-mentioned patent application is hereby incorporated by reference herein and made a part of this specification.

TECHNICAL FIELD

The present disclosure relates to an inkjet printer equipped with an inkjet head that ejects ink droplets. The present disclosure also relates to a control method for such an inkjet printer.

DESCRIPTION OF THE BACKGROUND ART

An inkjet printer that ejects ink droplets to performs printing on a print medium is conventionally known (see e.g., Japanese Unexamined Patent Publication No. 2011-156859, i.e., Patent Literature 1). The inkjet printer described in Japanese Unexamined Patent Publication No. 2011-156859 includes an inkjet head, a carriage on which the inkjet head is mounted, and an ink supply system that supplies ink to the inkjet head. The ink used in the inkjet printer described in Japanese Unexamined Patent Publication No. 2011-156859 is an ink containing ink fine particles such as a pigment, and is, for example, white ink, metallic ink, pearl ink, or the like.

In the inkjet printer described in Japanese Unexamined Patent Publication No. 2011-156859, the ink supply system includes a main tank, a sub tank, a first ink flow path connecting the main tank and the sub tank, a second ink flow path connecting the sub tank and the inkjet head, a third ink flow path connecting the sub tank and the first ink flow path, and a liquid feeding pump that feeds the ink in the third ink flow path from the sub tank toward the first ink flow path.

Furthermore, in the inkjet printer described in Japanese Unexamined Patent Publication No. 2011-156859, at a timing when the inkjet printer is in a standby state, the liquid feeding pump is driven to execute a circulation control for circulating ink in an ink circulation path configured by an ink chamber in the sub tank, the third ink flow path, and the first ink flow path. Therefore, in the inkjet printer described in Japanese Unexamined Patent Publication No. 2011-156859, the ink fine particles are prevented from being deposited (precipitated) in the ink chambers in the sub tank, and the decrease in the concentration of ink ejected from the inkjet head can be suppressed.

Patent Literature 1: Japanese Unexamined Patent Publication No. 2011-156859

SUMMARY

In the inkjet printer described in Japanese Unexamined Patent Publication No. 2011-156859, there is a possibility a portion where the ink flow is deteriorated in the ink chamber may form even if the ink is circulated by the circulation control depending on the shape of the ink chamber in the sub tank. For example, when the shape of the ink chamber is complex, there is a possibility that a portion where the ink flow is deteriorated in the ink chamber may form even if the ink is circulated by the circulation control. The ink fine particles are likely to deposit at the portion where the ink flow is deteriorated in the ink chamber. Thus, in the inkjet printer described in Japanese Unexamined Patent Publication No. 2011-156859, it may not be possible to suppress the deposition of ink fine particles in the ink chamber even if the ink is circulated depending on the shape of the ink chamber.

Thus, the present disclosure provides an inkjet printer capable of suppressing deposition of ink fine particles in a sub tank regardless of the shape of the ink chamber in the sub tank. The present disclosure also provides a control method for an inkjet printer capable of suppressing deposition of ink fine particles in a sub tank regardless of the shape of an ink chamber in the sub tank.

In order to solve the problems described above, an inkjet printer of the present disclosure includes an inkjet head that ejects ink droplets, and a sub tank that stores an ink to be supplied to the inkjet head; where the sub tank is provided with an ink outflow port through which the ink flows out from the sub tank, and an ink inflow port through which the ink that flowed out from the ink outflow port and passed through a predetermined circulation path flows toward the sub tank; and the ink is flowed out from the ink inflow port and the ink that passed through the circulation path is flowed into the sub tank from the ink outflow port at a predetermined timing.

In order to solve the problems described above, a control method for an inkjet printer of the present disclosure including an inkjet head that ejects ink droplets and a sub tank that stores an ink to be supplied to the inkjet head, the sub tank being provided with an ink outflow port through which the ink flows out from the sub tank, and an ink inflow port through which the ink that flowed out from the ink outflow port and passed through a predetermined circulation path flows toward the sub tank; where the ink is flowed out from the ink inflow port and the ink that passed through the circulation path is flowed into the sub tank from the ink outflow port at a predetermined timing.

In the present disclosure, at a predetermined timing, the ink is flowed out from the ink inflow port and the ink that passed through the circulation path is flowed into the sub tank from the ink outflow port at a predetermined timing. In other words, according to the present disclosure, a flow of ink in a direction opposite to a normal ink flow direction in which the ink that flowed out from the ink outflow port and passed through the predetermined circulation path flows into the ink inflow port is generated in the sub tank at a predetermined timing. Therefore, according to a review by the inventors of the present application, when the flow of ink in the direction opposite to the normal ink flow direction is generated in the sub tank, the flow of ink can be improved and the deposited ink fine particles can be flowed at an area where the flow of ink becomes worse when the ink is flowed in the normal ink flow direction in the sub tank. Therefore, according to the present disclosure, it is possible to suppress deposition of ink fine particles in the sub tank regardless of the shape of the ink chamber in the sub tank.

In the present disclosure, preferably, the inkjet head is an ink circulation type inkjet head provided with an ink supply port to which ink from the sub tank is supplied, an ink discharge port from which ink is discharged toward the sub tank, and a nozzle portion that ejects ink droplets; the ink outflow port and the ink supply port are connected by a first pipe, the ink discharge port and the ink inflow port are connected by a second pipe; and the circulation path is configured by an ink flow path provided in the inkjet head, the first pipe, and the second pipe.

According to such a configuration, it is possible to generate a flow of ink in a direction opposite to the normal ink flow direction in the ink flow path in the inkjet head at a predetermined timing. Therefore, even if an area where the flow of ink becomes worse forms in the ink flow path in the inkjet head when the ink is flowed in the normal ink flow direction, the flow of ink can be improved and the deposited ink fine particles can be flowed at an area where the flow of ink becomes worse when the ink is flowed in the normal ink flow direction in the ink flow path in the inkjet head when the flow of ink in a direction opposite to the normal ink flow direction is generated in the ink flow path in the inkjet head. As a result, it is possible to suppress deposition of ink fine particles in the ink flow path in the inkjet head.

In the present disclosure, preferably, the inkjet printer further includes a pressure adjustment mechanism that adjusts the pressure in the sub tank; where the sub tank is provided with an upstream ink chamber in which ink is stored and the ink outflow port is provided, a downstream ink chamber in which ink is stored and the ink inflow port is provided, and a partition wall that partitions the upstream ink chamber and the downstream ink chamber; the pressure adjustment mechanism includes a first pressure adjustment mechanism that adjusts the pressure of the upstream ink chamber, and a second pressure adjustment mechanism that adjusts the pressure of the downstream ink chamber, a flow of ink from the ink outflow port through the circulation path toward the ink inflow port being generated by making the pressure in the upstream ink chamber higher than the pressure in the downstream ink chamber, and a flow of ink from the ink inflow port through the circulation path toward the ink outflow port being generated by making the pressure in the downstream ink chamber higher than the pressure in the upstream ink chamber.

According to such a configuration, the flow of ink in the direction opposite to the normal ink flow direction can be generated in the sub tank and the inkjet head by adjusting the pressure in the upstream ink chamber and the pressure in the downstream ink chamber. Therefore, the flow of ink in the direction opposite to the normal ink flow direction can be generated in the sub tank and the inkjet head relatively easily.

In the present disclosure, preferably, the sub tank includes a first detection mechanism that detects an amount of ink in the upstream ink chamber, and a second detection mechanism that detects an amount of ink in the downstream ink chamber; and the pressure adjustment mechanism generates the flow of ink from the ink inflow port toward the ink outflow port until the first detection mechanism detects that the amount of ink in the upstream ink chamber is a predetermined amount on an upper limit side or the second detection mechanism detects that the amount of ink in the downstream ink chamber is a predetermined amount on a lower limit side. According to such a configuration, the flow of ink in the direction opposite to the normal ink flow direction can be automatically stopped.

In the present disclosure, preferably, the inkjet printer further includes a maintenance unit that cleans the inkjet head; where before ink droplets are forcibly ejected from the inkjet head in the maintenance unit, the ink is flowed out from the ink inflow port and the ink that passed through the circulation path is flowed into the sub tank from the ink outflow port.

According to such a configuration, even when ink fine particles are deposited in the ink flow path in the inkjet head, ink droplets can be forcibly ejected from the inkjet head in the maintenance unit after the amount of ink fine particles deposited in the ink flow path in the inkjet head is reduced. Therefore, even when ink fine particles are deposited in the ink flow path in the inkjet head, the amount of ink fine particles in the ink droplets forcibly ejected from the inkjet head in the maintenance unit can be reduced. As a result, it is possible to suppress a decrease in the concentration of ink in the inkjet head and the sub tank due to the ejection of ink droplets from the inkjet head in the maintenance unit.

In the present disclosure, preferably, the inkjet printer further includes a carriage on which the inkjet head and the sub tank are mounted, and a carriage drive mechanism that moves the carriage in a main scanning direction; where the carriage drive mechanism vibrates the carriage in a main scanning direction at a predetermined timing when the inkjet head is not ejecting ink droplets. That is, in the present disclosure, the carriage drive mechanism preferably vibrates the inkjet head and the sub tank mounted on the carriage in the main scanning direction at a predetermined timing when the inkjet head is not ejecting ink droplets.

According to such a configuration, the ink fine particles deposited in the sub tank can be diffused into the ink solvent. Therefore, it is possible to effectively suppress the deposition of the ink fine particles in the sub tank. Furthermore, according to such a configuration, even when the ink fine particles are deposited in the ink flow path in the inkjet head, the ink fine particles deposited in the ink flow path in the inkjet head can be diffused into the ink solvent. Therefore, it is possible to suppress the deposition of the ink fine particles in the ink flow path in the inkjet head.

Furthermore, in order to solve the problems described above, an inkjet printer of the present disclosure includes an inkjet head that ejects ink droplets, a sub tank that stores ink to be supplied to the inkjet head, and a carriage on which the inkjet head and the sub tank are mounted; where the carriage is vibrated at a predetermined timing when the inkjet head is not ejecting ink droplets.

Moreover, in order to solve the problems described above, a control method for an inkjet printer of the present disclosure is a control method for an inkjet printer including an inkjet head that ejects ink droplets, a sub tank that stores ink to be supplied to the inkjet head, and a carriage on which the inkjet head and the sub tank are mounted; where the carriage is vibrated at a predetermined timing when the inkjet head is not ejecting ink droplets.

In the present disclosure, the carriage is vibrated at a predetermined timing when the inkjet head is not ejecting ink droplets. That is, in the present disclosure, the sub tank mounted on the carriage is vibrated at a predetermined timing when the inkjet head is not ejecting ink droplets. Therefore, in the present disclosure, it is possible to diffuse the ink fine particles deposited in the sub tank into the ink solvent. Therefore, according to the present disclosure, it is possible to suppress deposition of ink fine particles in the sub tank regardless of the shape of the ink chamber in the sub tank.

Furthermore, in the present disclosure, since the inkjet head mounted on the carriage is vibrated at a predetermined timing when the inkjet head is not ejecting ink droplets, even in a case where the ink fine particles are deposited in the ink flow path in the inkjet head, the ink fine particles deposited in the ink flow path in the inkjet head can be diffused into the ink solvent. Therefore, in the present disclosure, it is possible to suppress deposition of ink fine particles in the ink flow path in the inkjet head.

In the present disclosure, the inkjet printer further includes, for example, a carriage drive mechanism that moves the carriage in a main scanning direction; where the carriage drive mechanism vibrates the carriage in a main scanning direction at a predetermined timing when the inkjet head is not ejecting ink droplets.

In the present disclosure, preferably, the inkjet printer further includes a maintenance unit that cleans the inkjet head; where the carriage drive mechanism vibrates the carriage in a main scanning direction before the ink droplets are forcibly ejected from the inkjet head in the maintenance unit.

According to such a configuration, even when ink fine particles are deposited in the ink flow path in the inkjet head, ink droplets can be forcibly ejected from the inkjet head in the maintenance unit after the amount of ink fine particles deposited in the ink flow path in the inkjet head is reduced. Therefore, even when ink fine particles are deposited in the ink flow path in the inkjet head, the amount of ink fine particles in the ink droplets forcibly ejected from the inkjet head in the maintenance unit can be reduced. As a result, it is possible to suppress a decrease in the concentration of ink in the inkjet head and the sub tank due to the ejection of ink droplets from the inkjet head in the maintenance unit.

As described above, according to the present disclosure, it is possible to suppress deposition of ink fine particles in the sub tank regardless of the shape of the ink chamber in the sub tank.

DETAILED DESCRIPTION OF EMBODIMENTS

Hereinafter, embodiments of the present disclosure will be described with reference to the accompanying drawings.

(Configuration of Inkjet Printer)

Figure 1:
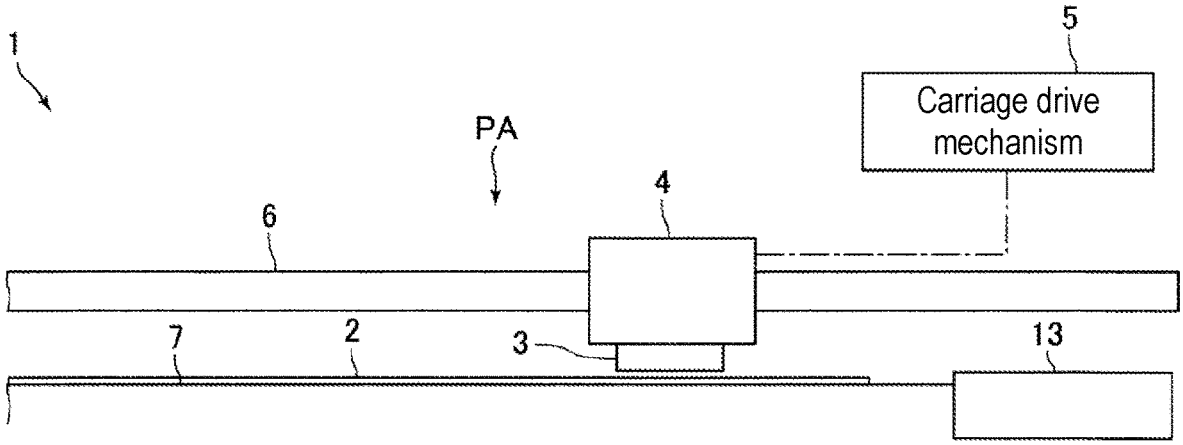
FIG. 1 is a schematic view for explaining a configuration of an inkjet printer according to an embodiment of the present disclosure.
Figure 2:
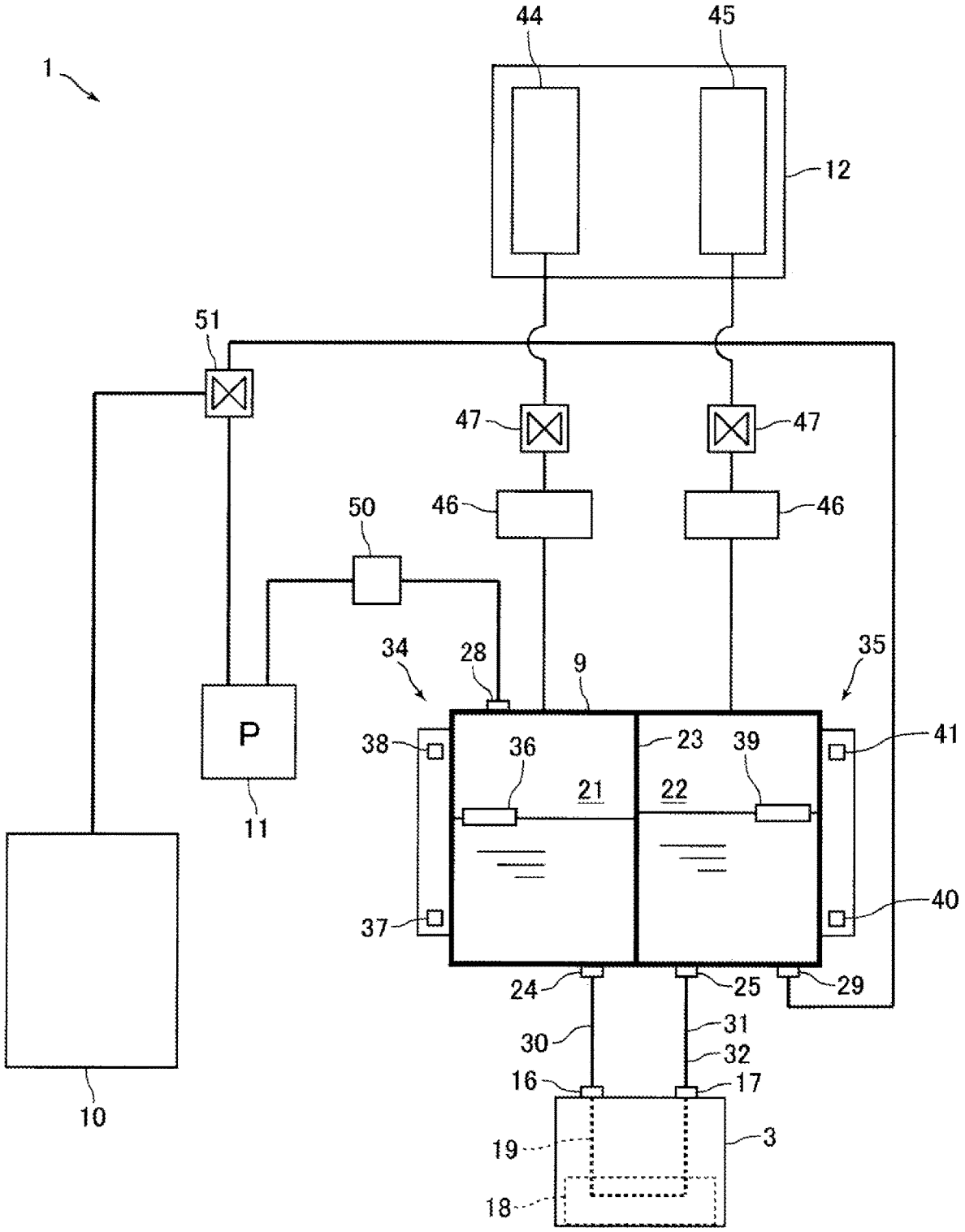
FIG. 2 is a schematic view for explaining the configuration of the inkjet printer shown in FIG. 1.

FIGS. 1 and 2 are schematic views for describing a configuration of an inkjet printer 1 according to an embodiment of the present disclosure.

An inkjet printer 1 (hereinafter referred to as "printer 1") of the present embodiment is, for example, a business inkjet printer, and performs printing on a print medium 2 such as paper. The printer 1 includes an inkjet head 3 (hereinafter referred to as "head 3") that ejects ink droplets, a carriage 4 on which the head 3 is mounted, a carriage drive mechanism 5 that moves the carriage 4 in a main scanning direction, a guide rail 6 for guiding the carriage 4 in the main scanning direction, and a platen 7 on which a print medium 2 at the time of printing is placed. The printer 1 may be a 3D printer for shaping a three-dimensional object. Furthermore, the printer 1 may be an inkjet printer for general consumers.

The carriage drive mechanism 5 includes a motor and a power transmission mechanism that transmits the power of the motor to the carriage 4. The power transmission mechanism includes, for example, a pulley and a belt. When printing on the print medium 2, the head 3 ejects ink droplets toward the upper surface of the print medium 2 placed on the platen 7 while the carriage 4 is guided by the guide rail 6 and reciprocates in the main scanning direction. The ink used in the printer 1 of the present embodiment is an ink in which ink fine particles such as pigment are contained in a solvent, and for example, is white ink, metallic ink, or pearl ink.

The printer 1 also includes a sub tank 9 that stores ink to be supplied to the head 3, a main tank 10 that stores ink to be supplied to the sub tank 9, an ink pump 11 that feeds the ink from the main tank 10 to the sub tank 9, a pressure adjustment mechanism 12 that adjusts the pressure in the sub tank 9, and a maintenance unit 13 for cleaning the head 3. The printer 1 includes a plurality of heads 3 and the plurality of heads 3 are mounted on the carriage 4. Furthermore, the printer 1 includes a plurality of sub tanks 9 corresponding to the number of heads 3 and a plurality of main tanks 10 corresponding to the number of sub tanks 9.

The head 3 in the present embodiment is an ink circulation type inkjet head that circulates ink in the head 3. The head 3 is formed with an ink supply port 16 through which ink from the sub tank 9 is supplied, an ink discharge port 17 through which ink is discharged toward the sub tank 9, and a nozzle portion 18 that discharges ink droplets. The nozzle portion 18 is formed with a plurality of nozzles that eject ink droplets. The head 3 includes a piezoelectric element (piezo element) that ejects ink droplets from nozzles. In the head 3, an ink flow path 19 that leads to the ink supply port 16 and the ink discharge port 17 is formed. One end of the flow path 19 is connected to the ink supply port 16. The other end of the flow path 19 is connected to the ink discharge port 17. Ink is supplied from the flow path 19 to the nozzle.

The sub tank 9 is mounted on the carriage 4. The sub tank 9 is disposed on the upper side of the head 3. In the sub tank 9, an upstream ink chamber 21 and a downstream ink chamber 22 in which ink is stored, and a partition wall 23 that partitions the upstream ink chamber 21 and the downstream ink chamber 22 are formed. In the present embodiment, the shape of the upstream ink chamber 21 and the shape of the downstream ink chamber 22 are relatively complex.

The upstream ink chamber 21 is formed with an ink outflow port 24 through which ink flows out from the upstream ink chamber 21 toward the head 3. In the downstream ink chamber 22, an ink inflow port 25 through which ink discharged from the head 3 flows in is formed. That is, the sub tank 9 is formed with the ink outflow port 24 through which ink flows out from the sub tank 9 and the ink inflow port 25 through which ink flows into the sub tank 9. Furthermore, the upstream ink chamber 21 is formed with an ink inflow port 28 through which ink from the main tank 10 or the downstream ink chamber 22 flows in, and the downstream ink chamber 22 is formed with an ink outflow port 29 through which the ink flows out toward the upstream ink chamber 21.

The ink outflow port 24 and the ink supply port 16 are connected by a pipe 30 serving as a first pipe. The ink discharge port 17 and the ink inflow port 25 are connected by a pipe 31 serving as a second pipe. In the present embodiment, an ink circulation path 32 is configured by the ink flow path 19 formed in the head 3 and the pipes 30 and 31, where the ink that flowed out from the ink outflow port 24 and passed through the circulation path 32 flows into the sub tank 9 from the ink inflow port 25.

The sub tank 9 includes a detection mechanism 34 for detecting the amount of ink in the upstream ink chamber 21 and a detection mechanism 35 for detecting the amount of ink in the downstream ink chamber 22. The detection mechanism 34 is a liquid level detection mechanism that detects the amount of ink in the upstream ink chamber 21 by detecting the liquid level of the ink in the upstream ink chamber 21. Similarly, the detection mechanism 35 is a liquid level detection mechanism that detects the amount of ink in the downstream ink chamber 22 by detecting the liquid level of the ink in the downstream ink chamber 22. The detection mechanism 34 of the present embodiment is a first detection mechanism, and the detection mechanism 35 is a second detection mechanism.

The detection mechanism 34 includes a float 36 disposed in the upstream ink chamber 21, and magnetic sensors 37, 38 such as Hall IC for detecting a magnet (permanent magnet) incorporated in the float 36. The float 36 floats on the ink in the upstream ink chamber 21. The magnetic sensors 37 and 38 are fixed to the outer side surface of the upstream ink chamber 21. The magnetic sensor 37 is fixed to the lower end side of the outer side surface of the upstream ink chamber 21, and the magnetic sensor 38 is fixed to the upper end side of the outer side surface of the upstream ink chamber 21.

In the present embodiment, the magnet incorporated in the float 36 is detected by the magnetic sensor 37 when the amount of ink in the upstream ink chamber 21 reaches a predetermined amount on the lower limit side, and the magnet incorporated in the float 36 is detected by the magnetic sensor 38 when the amount of ink in the upstream ink chamber 21 reaches a predetermined amount on the upper limit side. That is, the detection mechanism 34 detects that the amount of ink in the upstream ink chamber 21 is a predetermined amount on the lower limit side, and the amount of ink in the upstream ink chamber 21 is a predetermined amount on the upper limit side.

The detection mechanism 35 is configured similar to the detection mechanism 34, and includes a float 39 disposed in the downstream ink chamber 22, and magnetic sensors 40, 41 such as Hall IC for detecting a magnet (permanent magnet) incorporated in the float 39. The float 39 floats on the ink in the downstream ink chamber 22. The magnetic sensors 40 and 41 are fixed to the outer side surface of the downstream ink chamber 22. The magnetic sensor 40 is fixed to the lower end side of the outer side surface of the downstream ink chamber 22, and the magnetic sensor 41 is fixed to the upper end side of the outer side surface of the downstream ink chamber 22.

In the present embodiment, the magnet incorporated in the float 39 is detected by the magnetic sensor 40 when the amount of ink in the downstream ink chamber 22 reaches a predetermined amount on the lower limit side, and the magnet incorporated in the float 39 is detected by the magnetic sensor 41 when the amount of ink in the downstream ink chamber 22 reaches a predetermined amount on the upper limit side. That is, the detection mechanism 35 detects that the amount of ink in the downstream ink chamber 22 is a predetermined amount on the lower limit side, and the amount of ink in the downstream ink chamber 22 is a predetermined amount on the upper limit side.

The pressure adjustment mechanism 12 includes a first pressure adjustment mechanism 44 that adjusts the pressure in the upstream ink chamber 21, and a second pressure adjustment mechanism 45 that adjusts the pressure in the downstream ink chamber 22. The first pressure adjustment mechanism 44 includes a negative pressure pump for making the internal pressure of the upstream ink chamber 21 negative. The second pressure adjustment mechanism 45 includes a negative pressure pump for making the internal pressure of the downstream ink chamber 22 negative. The first pressure adjustment mechanism 44 is connected to the upstream ink chamber 21 through a backflow prevention filter 46 and an open/close valve 47, and the second pressure adjustment mechanism 45 is connected to the downstream ink chamber 22 through the backflow prevention filter 46 and the open/close valve 47.

At the time of using the printer 1, the pressure in the upstream ink chamber 21 is usually higher than the pressure in the downstream ink chamber 22. Specifically, at the time of using the printer 1, the negative pressure in the downstream ink chamber 22 is usually a negative pressure larger than the negative pressure in the upstream ink chamber 21. For example, the pressure in the upstream ink chamber 21 is −1.6 (kPa), and the pressure in the downstream ink chamber 22 is −3.8 (kPa). That is, the difference between the pressure in the upstream ink chamber 21 and the pressure in the downstream ink chamber 22 is, for example, 2.2 (kPa).

In the present embodiment, ink is supplied from the upstream ink chamber 21 to the head 3 and the ink is discharged from the head 3 to the downstream ink chamber 22 due to the difference between the pressure in the upstream ink chamber 21 and the pressure in the downstream ink chamber 22. In other words, the pressure adjustment mechanism 12 generates a flow of ink from the ink outflow port 24 toward the ink inflow port 25 through the circulation path 32 by making the pressure in the upstream ink chamber 21 higher than the pressure in the downstream ink chamber 22, and the ink in the head 3 circulates as the ink moves from the upstream ink chamber 21 toward the downstream ink chamber 22 through the circulation path 32.

The main tank 10 is detachably attached to a main body frame of the printer 1. The ink pump 11 is, for example, a diaphragm pump, and includes a motor as a drive source. The ink pump 11 is disposed in a pipe path between the main tank 10 and the upstream ink chamber 21. A filter 50 is disposed in the pipe path between the ink pump 11 and the upstream ink chamber 21. That is, the ink pump 11 is connected to an ink inflow port 28 by way of a predetermined pipe and the filter 50.

A three-way valve 51 is disposed in a pipe path between the main tank 10 and the ink pump 11. The three-way valve 51 is connected to the downstream ink chamber 22 through a pipe. That is, an ink outflow port 29 is connected to the three-way valve 51 through a pipe. In the present embodiment, normally, an ink flow path is formed in which the ink pump 11 feeds ink from the downstream ink chamber 22 to the upstream ink chamber 21 and the ink is fed from the downstream ink chamber 22 to the upstream ink chamber 21, but when the amount of ink in the sub tank 9 decreases, the three-way valve 51 is switched, and an ink flow path is formed in which the ink pump 11 feeds ink from the main tank 10 to the upstream ink chamber 21 and the ink is fed from the main tank 10 to the upstream ink chamber 21.

Assuming that a region where printing is performed on the print medium 2 in the main scanning direction is a printing region PA, a maintenance unit 13 is disposed in a region outside the printing region PA in the main scanning direction. The maintenance unit 13 includes a capping mechanism that covers the nozzle surface of the head 3, a wiper that wipes the nozzle surface of the head 3, and the like. In the maintenance unit 13, ink droplets are forcibly ejected from the head 3 in order to prevent problems such as clogging in the nozzles of the head 3.

Specifically, the maintenance unit 13 periodically performs purge (purging) for forcibly ejecting ink droplets from the head 3 by setting the pressure in the head 3 to a positive pressure. For example, the purge is performed every 8 hours, and before or after the purge is performed, the nozzle surface of the head 3 is wiped with the wiper. Furthermore, in the maintenance unit 13, flushing in which the piezoelectric element of the head 3 is driven to forcibly eject ink droplets from the head 3 is performed under a certain condition. In a case where the capping mechanism includes a suction pump for forcibly suctioning ink droplets from the nozzles of the head 3, the purge may be performed using the suction pump.

(Control Method for Inkjet Printer)

As described above, when the printer 1 is used, the negative pressure in the downstream ink chamber 22 is usually larger than the negative pressure in the upstream ink chamber 21, and the flow ink from the ink outflow port 24 toward the ink inflow port 25 through the circulation path 32 is generated. In the present embodiment, the flow of ink from the ink inflow port 25 toward the ink outflow port 24 through the circulation path 32 is generated at a predetermined timing. That is, in the present embodiment, the controller of the printer 1 performs an inverse circulation of ink for causing the ink to flow out from the ink inflow port 25 and the ink that has passed through the circulation path 32 to flow into the sub tank 9 from the ink outflow port 24 at a predetermined timing, so that a flow of ink in a direction opposite to the normal ink flow direction is generated in the sub tank 9 at a predetermined timing.

Specifically, the negative pressure of the upstream ink chamber 21 is set to a negative pressure larger than the negative pressure of the downstream ink chamber 22, and the flow of ink from the ink inflow port 25 to the ink outflow port 24 through the circulation path 32 is generated. That is, the pressure adjustment mechanism 12 generates a flow of ink from the ink inflow port 25 toward the ink outflow port 24 through the circulation path 32 by making the pressure of the downstream ink chamber 22 higher than the pressure of the upstream ink chamber 21.

In the present embodiment, the pressure adjustment mechanism 12 sets the pressure of the downstream ink chamber 22 higher than the pressure of the upstream ink chamber 21 by making the pressure of the downstream ink chamber 22 the same pressure as the pressure of the upstream ink chamber 21 at the normal time, and the pressure of the upstream ink chamber 21 the same pressure as the pressure of the downstream ink chamber 22 at the normal time. For example, the pressure in the downstream ink chamber 22 is set to −1.6 (kPa), and the pressure in the upstream ink chamber 21 is set to −3.8 (kPa). When the pressure in the downstream ink chamber 22 is higher than the pressure in the upstream ink chamber 21, the pressure in the downstream ink chamber 22 and the pressure in the upstream ink chamber 21 at the normal time may be different or the pressure in the upstream ink chamber 21 and the pressure in the downstream ink chamber 22 at the normal time may be different.

Furthermore, the pressure adjustment mechanism 12 generates the flow of ink from the ink inflow port 25 toward the ink outflow port 24 until the detection mechanism 34 detects that the amount of ink in the upstream ink chamber 21 is a predetermined amount on the upper limit side (i.e., until the magnet incorporated in the float 36 is detected by the magnetic sensor 38) or until the detection mechanism 35 detects that the amount of ink in the downstream ink chamber 22 is a predetermined amount on the lower limit side (i.e., until the magnet incorporated in the float 39 is detected by the magnetic sensor 40).

Further, the ink is caused to flow out from the ink inflow port 25 and the ink that has passed through the circulation path 32 is caused to flow into the sub tank 9 from the ink outflow port 24 before purge is performed in the maintenance unit 13. That is, the ink is inversely circulated before the ink droplets are forcibly ejected from the head 3 in the maintenance unit 13, and the inverse circulation of the ink is periodically performed.

In the present embodiment, the carriage drive mechanism 5 vibrates the carriage 4 in the main scanning direction at a predetermined timing when the head 3 is not ejecting ink droplets. That is, the controller of the printer 1 causes the carriage 4 to vibrate in the main scanning direction by the carriage drive mechanism 5 at a predetermined timing when the head 3 is not ejecting ink droplets, so that the head 3 and the sub tank 9 mounted on the carriage 4 are vibrated in the main scanning direction.

In the present embodiment, the carriage 4 is periodically vibrated in the main scanning direction. For example, the carriage 4 is vibrated in the main scanning direction once a day (that is, every 24 hours). Furthermore, for example, the carriage 4 is vibrated in the main scanning direction by reciprocating the carriage 4 10 times in the main scanning direction at substantially the same speed as the moving speed of the carriage 4 during printing on the print medium 2. The moving distance of the carriage 4 in the main scanning direction at this time is, for example, about 10 (cm). Moreover, the vibration of the carriage 4 in the main scanning direction is performed, for example, in the maintenance unit 13.

(Main Effect of the Present Embodiment)

As described above, in the present embodiment, the inverse circulation of the ink is performed at a predetermined timing, and a flow of ink in a direction opposite to the normal ink flow direction from the ink outflow port 24 toward the ink inflow port 25 through the circulation path 32 is generated in the upstream ink chamber 21 and the downstream ink chamber 22. Therefore, in the present embodiment, when the flow of ink in the direction opposite to the normal ink flow direction is generated in the upstream ink chamber 21 and the downstream ink chamber 22, the flow of ink can be improved and the deposited ink fine particles can be flowed at an area where the flow of ink becomes worse when the ink is flowed in the normal ink flow direction in the upstream ink chamber 21 and the downstream ink chamber 22. Therefore, in the present embodiment, even if the shapes of the upstream ink chamber 21 and the downstream ink chamber 22 are complex, deposition of the ink fine particles in the upstream ink chamber 21 and the downstream ink chamber 22 can be suppressed.

In the present embodiment, since the ink flow path 19 formed in the head 3 is included in the circulation path 32, the flow of ink in the direction opposite to the normal ink flow direction is also generated in the flow path 19 at a predetermined timing. Therefore, in the present embodiment, even if an area where the flow of ink becomes worse forms in the flow path 19 when the ink is flowed in the normal ink flow direction, the flow of ink can be improved and the deposited ink fine particles can be flowed at an area where the flow of ink becomes worse when the ink is flowed in the normal ink flow direction in the flow path 19 when the flow of ink in a direction opposite to the normal ink flow direction is generated in the flow path 19. As a result, in the present embodiment, the deposition of ink fine particles in the flow path 19 can be suppressed.

In the present embodiment, the sub tank 9 mounted on the carriage 4 is vibrated in the main scanning direction by vibrating the carriage 4 in the main scanning direction at a predetermined timing when the head 3 is not ejecting ink droplets. Thus, in the present embodiment, it is possible to diffuse the ink fine particles deposited in the sub tank 9 into the ink solvent. Therefore, in the present embodiment, even if the shapes of the upstream ink chamber 21 and the downstream ink chamber 22 are complex, deposition of the ink fine particles in the upstream ink chamber 21 and the downstream ink chamber 22 can be effectively suppressed.

In the present embodiment, the head 3 mounted on the carriage 4 is vibrated in the main scanning direction by vibrating the carriage 4 in the main scanning direction at a predetermined timing when the head 3 is not ejecting ink droplets, and thus even if the ink fine particles are deposited in the flow path 19 of the head 3, the ink fine particles deposited in the flow path 19 can be diffused into the ink solvent. Therefore, in the present embodiment, it is possible to effectively suppress the deposition of the ink fine particles in the flow path 19.

In the present embodiment, the pressure adjustment mechanism 12 sets the pressure in the upstream ink chamber 21 higher than the pressure in the downstream ink chamber 22 to generate a flow of ink from the ink outflow port 24 toward the ink inflow port 25 through the circulation path 32, and sets the pressure in the downstream ink chamber 22 higher than the pressure in the upstream ink chamber 21 to generate a flow of ink from the ink inflow port 25 toward the ink outflow port 24 through the circulation path 32. That is, in the present embodiment, a flow of ink in a direction opposite to the normal ink flow direction is generated in the sub tank 9 and the flow path 19 of the head 3 by adjusting the pressure in the upstream ink chamber 21 and the pressure in the downstream ink chamber 22. Thus, in the present embodiment, it is possible to generate a flow of ink in the direction opposite to the normal ink flow direction in the sub tank 9 and the flow path 19 of the head 3.

In the present embodiment, the pressure adjustment mechanism 12 generates the flow of ink from the ink inflow port 25 toward the ink outflow port 24 until the detection mechanism 34 detects that the amount of ink in the upstream ink chamber 21 is a predetermined amount on the upper limit side or until the detection mechanism 35 detects that the amount of ink in the downstream ink chamber 22 is a predetermined amount on the lower limit side. Therefore, in the present embodiment, it is possible to automatically stop the flow of ink in the direction opposite to the normal ink flow direction.

In the present embodiment, the inverse circulation of the ink is performed before the purge is performed in the maintenance unit 13. Therefore, in the present embodiment, even when ink fine particles are deposited in the flow path 19 of the head 3, it is possible to perform the purge to forcibly eject ink droplets from the head 3 after reducing the amount of ink fine particles deposited in the flow path 19. Therefore, in the present embodiment, the amount of ink fine particles in the ink droplets forcibly ejected from the head 3 when performing the purge can be reduced, and as a result, it is possible to suppress the ink concentration in the head 3 and the sub tank 9 from lowering due to the purge.

OTHER EMBODIMENTS

The above-described embodiment is an example of a preferred embodiment of the present disclosure, but the present disclosure is not limited thereto, and various modifications can be made without changing the gist of the present disclosure.

In the embodiment described above, the inverse circulation of ink may be performed after the purge is performed, or the inverse circulation of ink may be performed at a predetermined timing irrelevant to the timing of performing the purge. In the embodiment described above, the inverse circulation of ink may be performed before flushing is performed in the maintenance unit 13. In this case, even when the ink fine particles are deposited in the flow path 19 of the head 3, it is possible to prevent the ink concentration in the head 3 and the sub tank 9 from lowering due to the flushing. Furthermore, the inverse circulation of ink may be performed after the flushing is performed.

In the embodiment described above, the carriage 4 may be vibrated in the main scanning direction before purge or flushing is performed in the maintenance unit 13 (i.e., before ink droplets are forcibly ejected from the head 3 in the maintenance unit 13). In this case, even when the ink fine particles are deposited in the flow path 19 of the head 3, purge or flushing is performed after the amount of ink fine particles deposited in the flow path 19 is reduced, and thus it is possible to suppress the ink concentration in the head 3 and the sub tank 9 from lowering due to the purge and the flushing.

Figure 3:
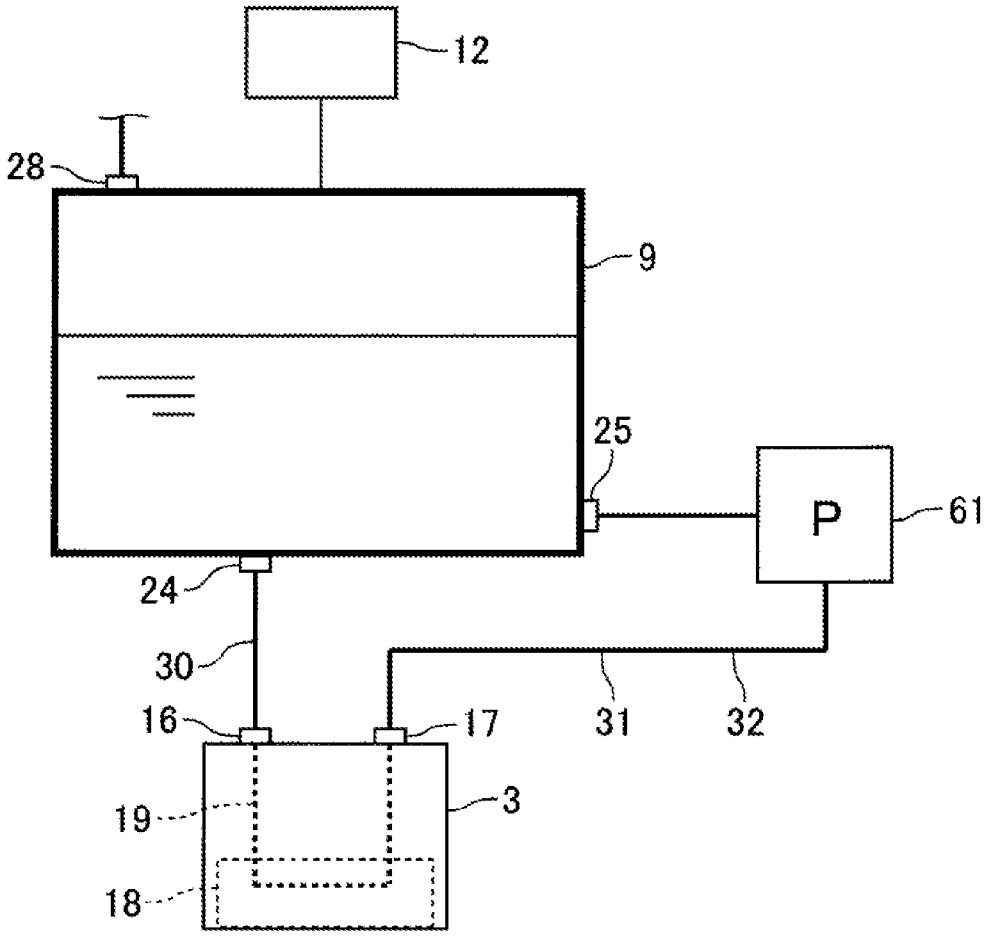
FIG. 3 is a schematic view for explaining a configuration of an inkjet printer according to another embodiment of the present disclosure.

In the embodiment described above, the ink in the head 3 is circulated by the difference between the pressure in the upstream ink chamber 21 and the pressure in the downstream ink chamber 22, but as shown in FIG. 3, the printer 1 may include an ink pump 61 for circulating the ink in the head 3. In this case, one ink chamber is formed in the sub tank 9. Furthermore, in this case, the ink pump 61 is disposed in the middle of the pipe 31. In this case, the ink pump 61 generates a normal ink flow from the ink outflow port 24 toward the ink inflow port 25 through the circulation path 32 and an ink flow in the opposite direction from the ink inflow port 25 toward the ink outflow port 24 through the circulation path 32. In FIG. 3, the configurations similar to those described above are denoted with the same reference numerals.

Figure 4:
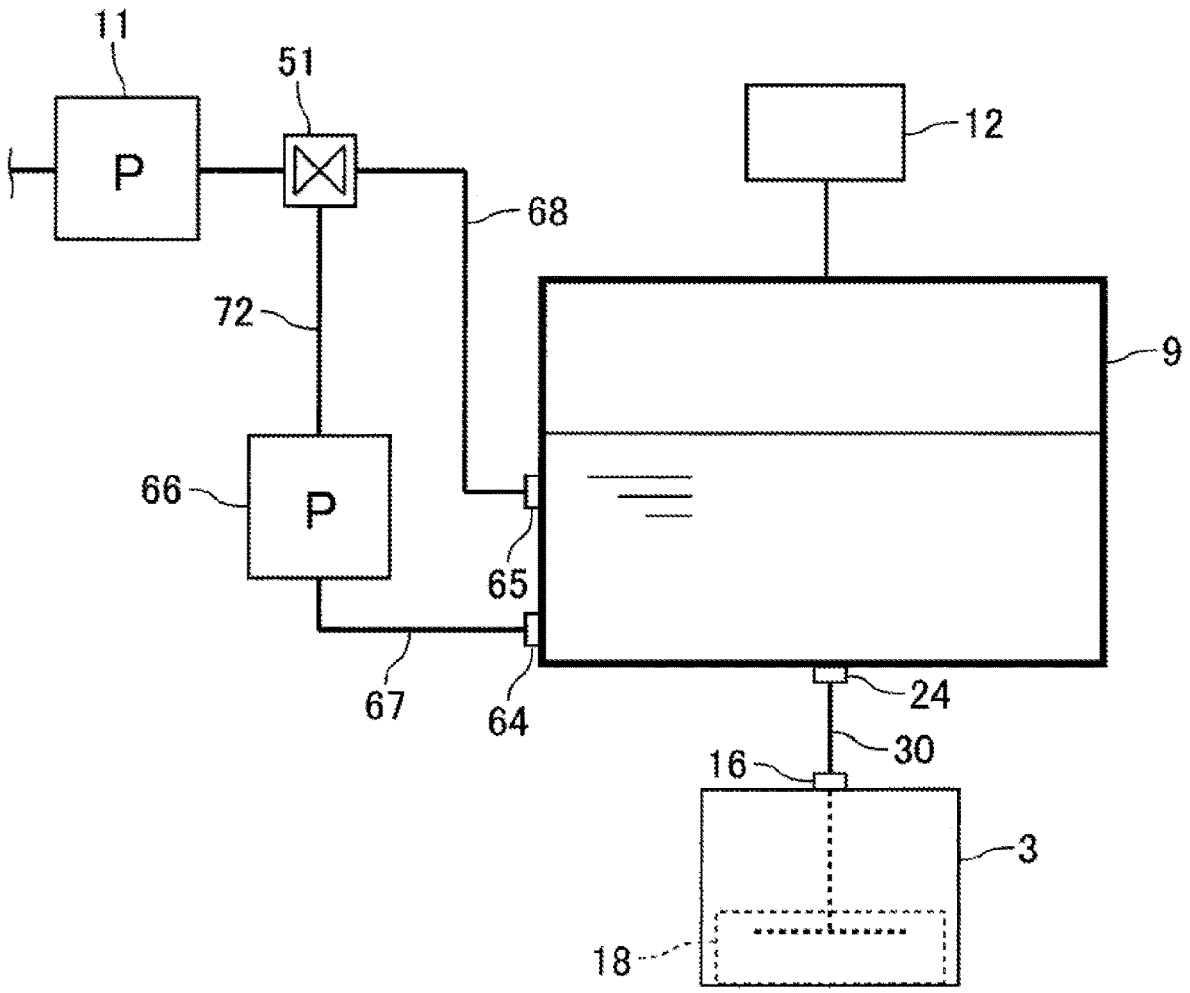
FIG. 4 is a schematic view for explaining a configuration of an inkjet printer according to another embodiment of the present disclosure.

In the embodiment described above, the head 3 may not be an ink circulation type inkjet head. In this case, as shown in FIG. 4, one ink chamber may be formed in the sub tank 9. Furthermore, the sub tank 9 is formed with an ink outflow port 64 through which ink flows out from the sub tank 9 and an ink inflow port 65 through which ink flows toward the sub tank 9. Furthermore, in this case, the printer 1 includes, for example, an ink pump 66 for circulating ink in the sub tank 9, a pipe 67 for connecting the ink outflow port 64 and the three-way valve 51, and a pipe 68 for connecting the ink inflow port 65 and the three-way valve 51. In FIG. 4, the configurations similar to those described above are denoted with the same reference numerals.

In the example shown in FIG. 4, the ink pump 11 is disposed in a pipe path between the main tank 10 and the three-way valve 51, and the ink pump 66 is disposed in the middle of the pipe 67. The pipe 67 and the pipe 68 configure an ink circulation path 72. In the example shown in FIG. 4, an ink flow path that connects the ink outflow port 64 and the ink inflow port 65 is normally formed, but when the amount of ink in the sub tank 9 decreases, the three-way valve 51 is switched and an ink flow path is formed in which the ink pump 11 sends ink from the main tank 10 to the sub tank 9, and ink is sent from the main tank 10 to the sub tank 9. At this time, ink flows into the sub tank 9 from the ink inflow port 65.

In the example shown in FIG. 4, when the printer 1 is used, the ink pump 66 normally causes the ink to flow out from the ink outflow port 64 and the ink that has passed through the circulation path 72 to flow into the sub tank 9 from the ink inflow port 65, but causes the ink to flow out from the ink inflow port 65 and the ink that has passed through the circulation path 72 to flow into the sub tank 9 from the ink outflow port 64 at a predetermined timing, so that a flow of ink in the direction opposite to the normal ink flow direction is generated in the sub tank 9 at a predetermined timing. In a modified example shown in FIG. 4, when the flow of ink in the direction opposite to the normal ink flow direction is generated in the sub tank 9, the flow of ink can be improved and the deposited ink fine particles can be flowed at an area where the flow of ink becomes worse when the ink is flowed in the normal ink flow direction in the sub tank 9, and thus the deposition of ink fine particles in the sub tank 9 can be suppressed even if the shape in the sub tank 9 is complex.

In the embodiment described above, if the inverse circulation of ink is performed at a predetermined timing, the carriage 4 may not be vibrated in the main scanning direction at a predetermined timing when the head 3 is not ejecting ink droplets. Furthermore, in the embodiment described above, when the carriage 4 is vibrated in the main scanning direction at a predetermined timing when the head 3 is not ejecting ink droplets, the inverse circulation of ink may not be performed at a predetermined timing.

In the embodiment described above, the carriage 4 may be vibrated in the vertical direction, or the carriage 4 may be vibrated in the sub-scanning direction orthogonal to the main scanning direction and the vertical direction at a predetermined timing when the head 3 is not ejecting ink droplets. In the embodiment described above, the carriage 4 may be vibrated in a horizontal direction other than the main scanning direction and the sub-scanning direction, or the carriage 4 may be vibrated in a random direction including the vertical direction and the horizontal direction at a predetermined timing when the head 3 is not ejecting ink droplets.

What is claimed is:

1. An inkjet printer, comprising:

an inkjet head that ejects ink droplets, and a sub tank that stores an ink to be supplied to the inkjet head;

wherein the sub tank is provided with an ink outflow port through which the ink flows out from the sub tank, and an ink inflow port through which the ink that flowed out from the ink outflow port and passed through a circulation path flows toward the sub tank;

the ink is flowed out from the ink inflow port and the ink that passed through the circulation path is flowed into the sub tank from the ink outflow port;

wherein the inkjet head is an ink circulation type inkjet head provided with an ink supply port to which the ink from the sub tank is supplied, an ink discharge port from which the ink is discharged toward the sub tank, and a nozzle portion that ejects ink droplets;

the ink outflow port and the ink supply port are connected by a first pipe;

the ink discharge port and the ink inflow port are connected by a second pipe; and the circulation path is configured by an ink flow path provided in the inkjet head, the first pipe, and the second pipe;

the subs tank is further provided with a second ink outflow port and a second ink inflow port, by using a second circulation path provided separately from the circulation path, the ink flowed out from the second ink outflow port passes through the second circulation path and flows into the sub tank from the second ink inflow port.

2. The inkjet printer according to claim 1, further comprising:

a maintenance unit that cleans the inkjet head;

wherein before ink droplets are forcibly ejected from the inkjet head in the maintenance unit, the ink is flowed out from the ink inflow port and the ink that passed through the circulation path is flowed into the sub tank from the ink outflow port.

3. The inkjet printer according to claim 2, further comprising:

a carriage on which the inkjet head and the sub tank are mounted, and a carriage drive mechanism that moves the carriage in a main scanning direction; wherein the carriage drive mechanism vibrates the carriage in a main scanning direction when the inkjet head is not ejecting ink droplets.

4. The inkjet printer according to claim 1, further comprising:

a carriage on which the inkjet head and the sub tank are mounted, and a carriage drive mechanism that moves the carriage in a main scanning direction; wherein the carriage drive mechanism vibrates the carriage in a main scanning direction when the inkjet head is not ejecting ink droplets.

5. An inkjet printer, comprising:

an inkjet head that ejects ink droplets, and a sub tank that stores an ink to be supplied to the inkjet head;

wherein the sub tank is provided with an ink outflow port through which the ink flows out from the sub tank, and an ink inflow port through which the ink that flowed out from the ink outflow port and passed through a circulation path flows toward the sub tank;

the ink is flowed out from the ink inflow port and the ink that passed through the circulation path is flowed into the sub tank from the ink outflow port;

wherein the inkjet head is an ink circulation type inkjet head provided with an ink supply port to which the ink from the sub tank is supplied, an ink discharge port from which the ink is discharged toward the sub tank, and a nozzle portion that ejects ink droplets;

the ink outflow port and the ink supply port are connected by a first pipe;

the ink discharge port and the ink inflow port are connected by a second pipe; and the circulation path is configured by an ink flow path provided in the inkjet head, the first pipe, and the second pipe;

wherein the inkjet printer further comprises a pressure adjustment mechanism that adjusts the pressure in the sub tank;

wherein the sub tank is provided with:

an upstream ink chamber in which the ink is stored and the ink outflow port is provided, a downstream ink chamber in which the ink is stored and the ink inflow port is provided, and a partition wall that partitions the upstream ink chamber and the downstream ink chamber;

wherein the pressure adjustment mechanism includes:

a first pressure adjustment mechanism that adjusts the pressure of the upstream ink chamber, and a second pressure adjustment mechanism that adjusts the pressure of the downstream ink chamber, wherein a flow of the ink from the ink outflow port through the circulation path toward the ink inflow port being generated by making the pressure in the upstream ink chamber higher than the pressure in the downstream ink chamber, and a flow of the ink from the ink inflow port through the circulation path toward the ink outflow port being generated by making the pressure in the downstream ink chamber higher than the pressure in the upstream ink chamber.

6. The inkjet printer according to claim 5, wherein the sub tank includes:

a first detection mechanism that detects an amount of the ink in the upstream ink chamber, and a second detection mechanism that detects an amount of the ink in the downstream ink chamber;

wherein the pressure adjustment mechanism generates the flow of the ink from the ink inflow port toward the ink outflow port until the first detection mechanism detects that the amount of the ink in the upstream ink chamber is a predetermined amount on an upper limit side or the second detection mechanism detects that the amount of the ink in the downstream ink chamber is a predetermined amount on a lower limit side.

7. The inkjet printer according to claim 6, further comprising:

a maintenance unit that cleans the inkjet head;

wherein before ink droplets are forcibly ejected from the inkjet head in the maintenance unit, the ink is flowed out from the ink inflow port and the ink that passed through the circulation path is flowed into the sub tank from the ink outflow port.

8. The inkjet printer according to claim 7, further comprising:

a carriage on which the inkjet head and the sub tank are mounted, and a carriage drive mechanism that moves the carriage in a main scanning direction; wherein the carriage drive mechanism vibrates the carriage in a main scanning direction when the inkjet head is not ejecting ink droplets.

9. The inkjet printer according to claim 6, further comprising:

a carriage on which the inkjet head and the sub tank are mounted, and a carriage drive mechanism that moves the carriage in a main scanning direction; wherein the carriage drive mechanism vibrates the carriage in a main scanning direction when the inkjet head is not ejecting ink droplets.

10. The inkjet printer according to claim 5, further comprising:

a maintenance unit that cleans the inkjet head;

wherein before ink droplets are forcibly ejected from the inkjet head in the maintenance unit, the ink is flowed out from the ink inflow port and the ink that passed through the circulation path is flowed into the sub tank from the ink outflow port.

11. The inkjet printer according to claim 10, further comprising:

a carriage on which the inkjet head and the sub tank are mounted, and a carriage drive mechanism that moves the carriage in a main scanning direction; wherein the carriage drive mechanism vibrates the carriage in a main scanning direction when the inkjet head is not ejecting ink droplets.

12. The inkjet printer according to claim 5, further comprising:

a carriage on which the inkjet head and the sub tank are mounted, and a carriage drive mechanism that moves the carriage in a main scanning direction; wherein the carriage drive mechanism vibrates the carriage in a main scanning direction when the inkjet head is not ejecting ink droplets.

13. An inkjet printer, comprising:

an inkjet head that ejects ink droplets;

a sub tank that stores an ink to be supplied to the inkjet head; and a carriage on which the inkjet head and the sub tank are mounted;

wherein the carriage is vibrated by an operation other than printing using the inkjet head at a timing that is capable of suppressing deposition of ink fine particles contained in the ink in the sub tank when the inkjet head is not ejecting ink droplets.

14. The inkjet printer according to claim 13, further comprising:

a carriage drive mechanism that moves the carriage in a main scanning direction; wherein the carriage drive mechanism vibrates the carriage in a main scanning direction when the inkjet head is not ejecting ink droplets.

15. The inkjet printer according to claim 14, further comprising:

a maintenance unit that cleans the inkjet head;

wherein the carriage drive mechanism vibrates the carriage in a main scanning direction before the ink droplets are forcibly ejected from the inkjet head in the maintenance unit.

* * * * *